US006716051B1

(12) United States Patent
Zeng

(10) Patent No.: US 6,716,051 B1
(45) Date of Patent: Apr. 6, 2004

(54) ELECTRICAL CONNECTOR WITH DISTORTION-RESISTANT COVER

(75) Inventor: Jin Min Zeng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 38 days.

(21) Appl. No.: 10/339,860

(22) Filed: Jan. 10, 2003

(30) Foreign Application Priority Data

Oct. 18, 2002 (TW) ..... 91216623 U

(51) Int. Cl.[7] ..... H01R 4/50
(52) U.S. Cl. ..... 439/342
(58) Field of Search ..... 439/342, 259

(56) References Cited

U.S. PATENT DOCUMENTS 6,254,415 B1 * 7/2001 Mizumura et al. ..... 439/342
6,296,506 B1 * 10/2001 Mizumura et al. ..... 439/342
6,338,640 B1 * 1/2002 Lin ..... 439/342
6,340,309 B1 * 1/2002 Lin et al. ..... 439/342
6,431,900 B1 * 8/2002 Yu ..... 439/342
6,450,827 B1 * 9/2002 Huang et al. ..... 439/342
6,464,525 B2 * 10/2002 Mizumura ..... 439/342
6,475,013 B1 * 11/2002 Pang et al. ..... 439/342
6,500,019 B1 * 12/2002 Tan ..... 439/342
6,508,659 B1 * 1/2003 Howell et al. ..... 439/342

* cited by examiner

*Primary Examiner*—Gary Paumen
*Assistant Examiner*—James R. Harvey

(57) ABSTRACT

An electrical connector (4) for electrically connecting an electrical component and a printed circuit board (PCB) includes a base (1) having a plurality of passageways (11) for receiving corresponding contacts therein, a cover (2) slidably mounted on the base and an actuation mechanism (3) disposed at an end of the connector. The cover includes a main plate (21), and two side plates (22) depending from opposite sides of the main plate. A plurality of cutouts (222) are defined in each said side plate for counterbalancing the body stress to prevent the cover from warping with respect to the base during a manufacturing process of the connector.

3 Claims, 3 Drawing Sheets

ELECTRICAL CONNECTOR WITH DISTORTION-RESISTANT COVER

BACKGROUND OF THE INVENTION

1. Field of the Invention

The present invention relates to an electrical connector for electrically connecting an electronic package such as a central processing unit (CPU) with a circuit substrate such as a printed circuit board (PCB), and particularly to an electrical connector having a cover configured to have minimal distortion.

2. Description of Related Art

CPU sockets are widely used in personal computer (PC) systems to electrically connect CPUs with PCBs. A typical CPU socket comprises a base having a plurality of passageways receiving corresponding electrical contacts therein, and a cover slidably engaged on the base. The cover defines a plurality of holes corresponding to the passageways. A conventional CPU socket further comprises an actuation mechanism to drive pins of the CPU into electrical engagement with the contacts of the base.

A conventional CPU socket with a slidable cover is disclosed in "Development of a ZIF BGA Socket" (Connector Specifier Magazine, May 2000, pp.16~18). Similar structures are also disclosed in U.S. Pat. Nos. 6,419,514 and 6,340,309, and Taiwan patent issue Nos. 502,882, 487,230, and 481,360.

A cover of a conventional CPU socket comprises a main plate and two side plates extending downwardly from two opposite sides of the main plate respectively. The main plate is relatively broad and flat, and is prone to distort. This is especially the case when the CPU socket is heated and soldered to the PCB to establish electrical connection with the PCB.

If the cover is distorted, it cannot engage on the base so that it is parallel to the base. The holes of the cover may not accurately coincide with the passageways of the base. This can impair mechanical and electrical engagement of the pins of the CPU with the contacts of the base. As a result, the reliability of electrical transmission through the CPU socket may be adversely affected. It can even result in failure of electrical connection between the CPU and the CPU socket.

Therefore, an improved electrical connector that overcomes the above-mentioned disadvantages is desired.

SUMMARY OF THE INVENTION

Accordingly, an object of the present invention is to provide an electrical connector for electrically connecting an electronic package such as a CPU with a circuit substrate such as a PCB, the electrical connector comprising a cover configured to have minimal distortion during manufacture, installation, use and operation of the electrical connector.

To achieve the above-mentioned object, an electrical connector for electrically connecting a CPU with a PCB is provided by the present invention. In a preferred embodiment, the electrical connector comprises a base having a plurality of passageways for receiving corresponding contacts therein, a cover slidably mounted on the base and an actuation mechanism disposed at an end of the connector.

The cover comprises a main plate, and two side plates depending from opposite sides of the main plate. A plurality of cutouts are defined in each said side plate for counterbalancing the body stress to prevent the cover from warping with respect to the base during a manufacturing process of the connector.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
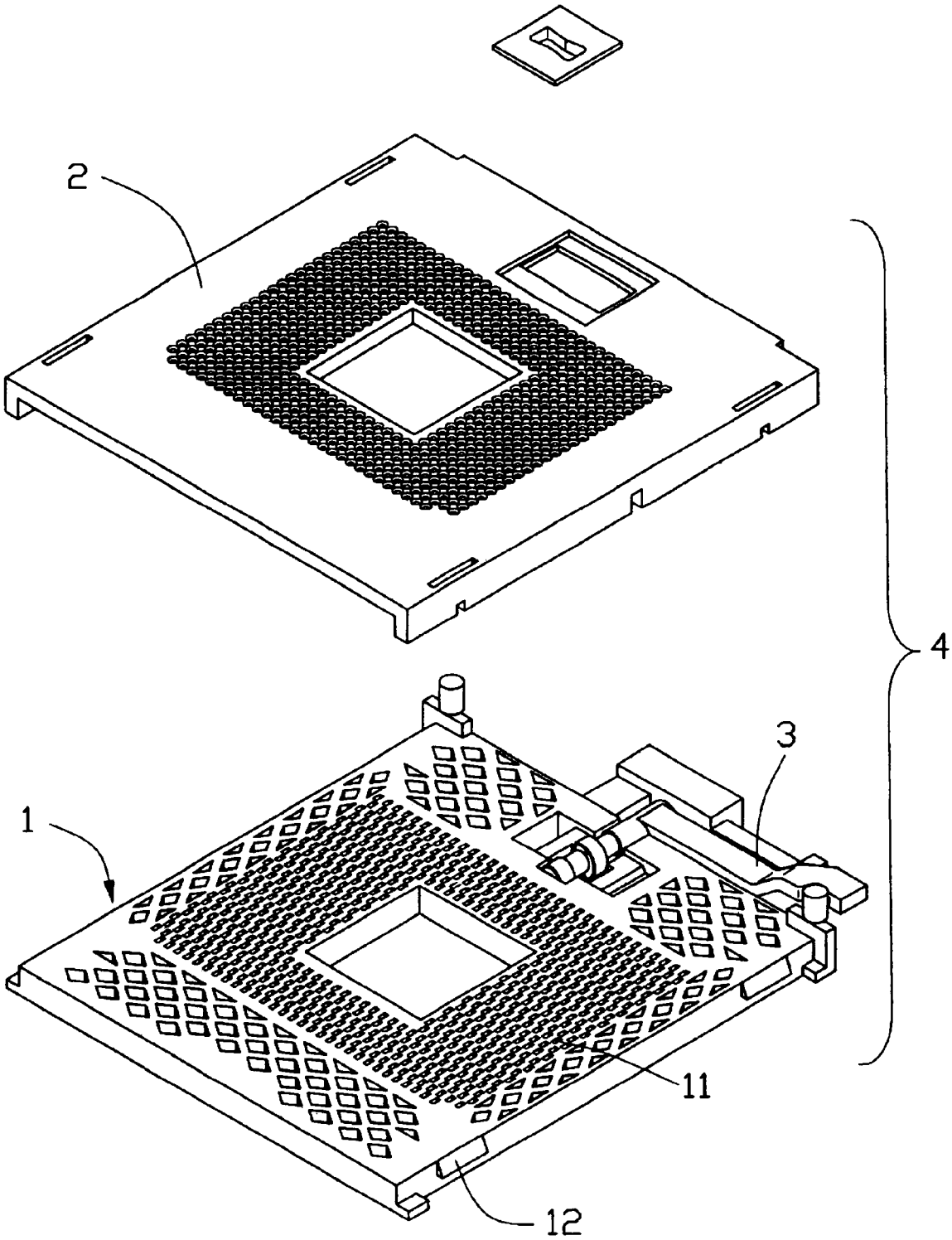
FIG. 1 is an exploded isometric view of the electrical connector in accordance with the preferred embodiment of the present invention, but not showing conductive contacts thereof.
Figure 2:
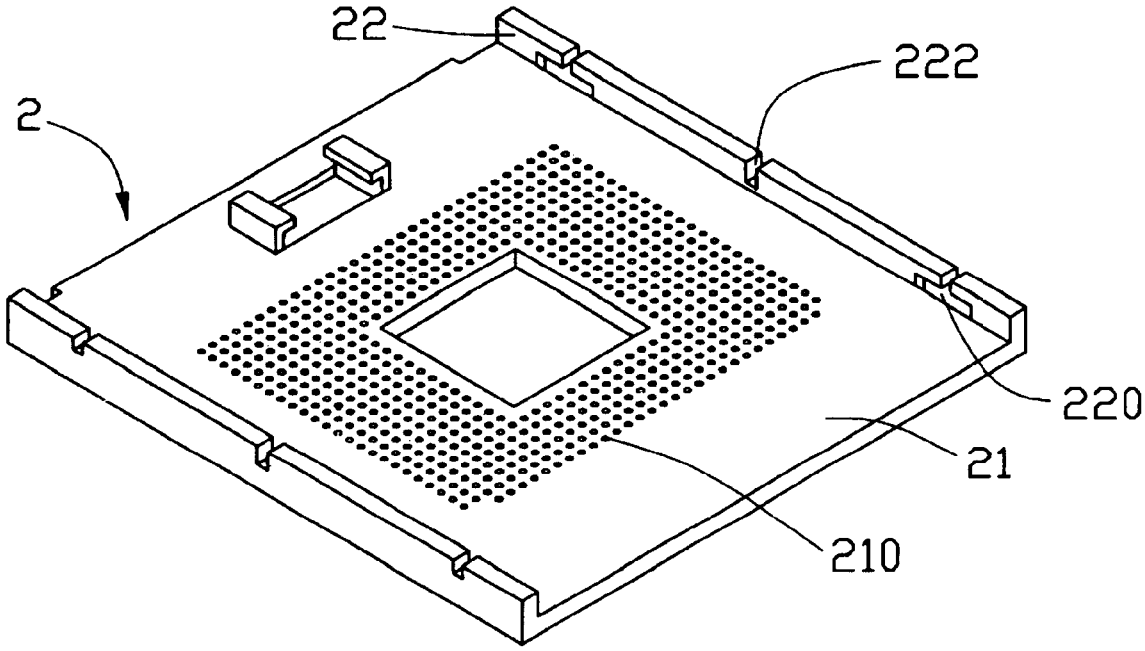
FIG. 2 is an isometric view of a cover of the electrical connector of FIG. 1, viewed showing the cover inverted.
Figure 3:
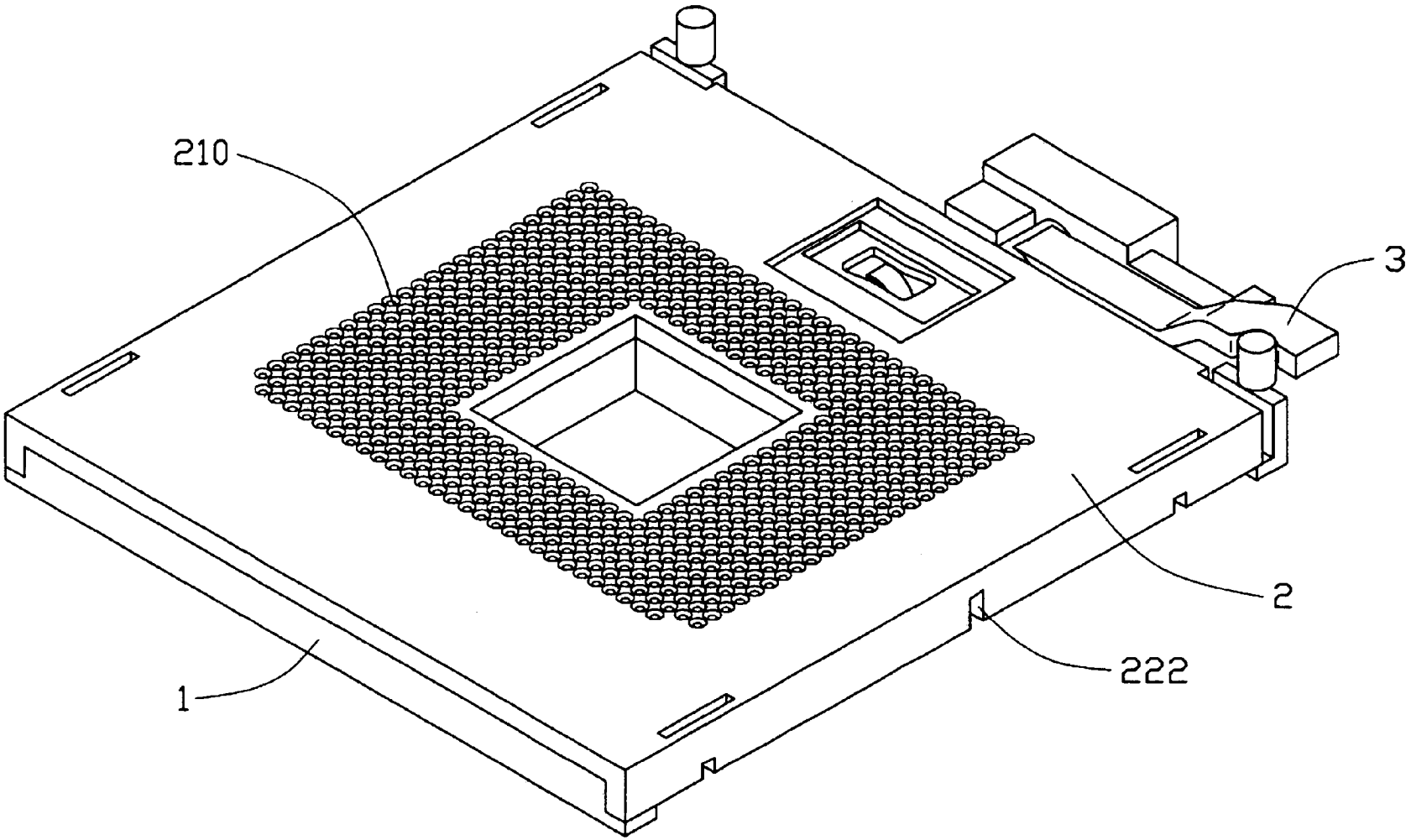
FIG. 3 is an assembled view of FIG. 1.

Referring to FIGS. 1, 2 and 3, an electrical connector 4 in accordance with a preferred embodiment of the present invention is for electrically connecting a central processing unit (CPU) (not shown) to a printed circuit board (PCB) (not shown). The connector 4 comprises an insulative base 1 fixed on the PCB, a cover 2 slidably mounted on the base 1, and an actuation mechanism 3 disposed at an end of the connector 4.

The base 1 defines a plurality of passageways 11 arranged in a rectangular array for receiving corresponding conductive contacts (not shown) therein. Two opposite sides of the base 1 are parallel to a direction that the cover 2 slides along the base 1. Each of said opposite sides forms a pair of spaced protrusions 12 thereon, for engaging with the cover 2.

The cover 2 comprises a main plate 21, and two side plates 22 depending from opposite sides of main plate 21 respectively. A multiplicity of through holes 210 is defined in the main plate 21. The through holes 210 correspond to the passageways 11 of the base 1 respectively. A pair of recesses 220 is defined in an inner face of each side plates 22, for slidably receiving the protrusions 12 of the base 1. A length of each recess 220 is greater than a length of each protrusion 12, thus allowing the cover 2 to slide along the base 1.

Each side plate 22 further defines three evenly spaced cutouts 222 at a bottom edge thereof. The cutouts 222 disposed at two ends of each side plate 22 are corresponding to the recesses 220 respectively. A middle one of the cutouts 222 is deeper than the other two cutouts 222. That is, said middle cutout 222 is nearest the main plate 21. This configuration counterbalances stress that may be concentrated in a main middle portion of the cover. Said other two cutouts 222 have equal depths. Thus the cover 2 is configured to be less liable to sustain warpage.

When the cover 2 is mounted on the base 1, the protrusions 12 of the base 1 are snappingly and slidably received in the recesses 220 of the cover 2. The passageways 11 of the base 1 are aligned with the through holes 210 of the cover 2 respectively. When the CPU is attached to the connector 4, pins (not shown) of the CPU are received through the through holes 210 of the cover 2 into the passageways 11 of the base 1. Then the actuation mechanism 3 is operated to drive the cover 2 to slide along the base 1. The pins of the CPU are thus pushed to engage with the contacts of the base 1. Thus electrical connection between the CPU and the PCB is established.

In addition, the cutouts 222 of the side plates 22 can counterbalance stress in the cover 2 during manufacturing thereof. This reduces the risk of the cover 2 being formed with warpage. In comparison with the previous design which only forms gaps in the side plate to enhance resiliency of the side plate for compliance with protrusions formed on the side walls of the base so as to ease assembling, the invention intentionally provides a deeper/larger cutout in the middle portion of the side plate for reducing stress concentration. In this embodiment, the middle cutout is isolated from any recess while the cutouts around two end portions of the side plate communicate with the associated recesses which are used to receive the corresponding protrusions formed on the side wall of the base.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an electronic package to a circuit substrate, the electrical connector comprising:

a base having a plurality of conductive contacts received therein; and a cover slidably mounted on the base, the cover comprising a main plate and two side plates extending from opposite sides of the cover; and an actuation mechanism disposed at an end of the connector;

wherein each of the side plates defines at least one cutout which is configured and dimensioned to be large enough and close enough to the main plate for counterbalancing stress in the cover;

wherein three cutouts are defined in each of the side plates;

wherein a middle one of the cutouts is deeper than the other two cutouts;

wherein a plurality of protrusions is formed on each of opposite sides of the base corresponding to the side plates of the cover, a plurality of recesses is defined in inner faces of each of the side plates, and the protrusions are slidably encaged in the recesses;

wherein a length of each of the recesses is greater than a length of each of the protrusions;

wherein the cutouts disposed at two ends of each side plate are corresponding to the recesses respectively.

2. An electrical connector for electrically connecting an electronic package to a circuit substrate, the electrical connector comprising:

a base having a plurality of conductive contacts received therein; and a cover movably engaged on the base, the cover comprising a main plate and a pair of side plates extending from respective opposite sides of the cover in a same direction;

wherein at least one cutout is defined in an intermediate portion of each of the side plates, said cutout being configured and dimensioned to be large enough and be close enough to the main plate for counterbalancing body stress of the cover;

wherein three cutouts are defined in each of the side plates;

wherein a middle one of the cutouts is deeper than the other two cutouts;

wherein a plurality of protrusions is formed on each of opposite sides of the base corresponding to the side plates of the cover, a plurality of recesses is defined in inner faces of each of the side plates, and the protrusions are movably engaged in the recesses;

wherein a length of each of the recesses is greater than a length of each of the protrusions;

wherein the cutouts disposed at two ends of each side plate correspond to the recesses respectively, further comprising an actuation mechanism disposed at an end of the connector.

3. An electrical connector comprising:

a base having a plurality of terminals therein;

a cover mounted on the base and slidable along a lengthwise direction relative to the base, said cover including:

a main plate defining a plurality of through holes in alignment with the terminals in a vertical direction, respectively; and a pair of side plates downwardly extending from two opposite lateral sides of the main plate and engaged on exterior side walls of the base, respectively; wherein a cutout is formed in a middle portion of at least one of the main plate and said side plate, said cover being dimensioned to be large enough or to be close enough to the main plate so as to counterbalance body stress of the cover;

wherein said base includes a plurality of protrusions on each of said exterior side walls of the base, and each of said side plates defines a plurality of recesses to receive said protrusions;

wherein said cutout is spatially isolated from said protrusions;

wherein said cutout is formed on the side plate, and two other cutouts are formed on said side plate and by two sides of the cutout;

wherein said two other cutouts communicate with said recesses, respectively, while said cutout is not;

wherein said cutout is deeper than said other two cutouts.

* * * * *